US006037853A

United States Patent [19]

Chabay

[11] Patent Number: 6,037,853

[45] Date of Patent: Mar. 14, 2000

[54] APPARATUS FOR DISPLAYING THE INTERACTIONS BETWEEN MAGNETIC FIELDS

[75] Inventor: Ilan S. Chabay, Redwood City, Calif.

[73] Assignee: The New Curiosity Shop Inc., Mountain View, Calif.

[21] Appl. No.: 09/216,508

[22] Filed: Dec. 18, 1998

Related U.S. Application Data

[63] Continuation-in-part of application No. 08/790,538, Jan. 30, 1997, Pat. No. 5,886,608.

[51] Int. Cl.[7] ..... A63H 33/26; G09F 19/00; H01F 7/02; A63B 71/00

[52] U.S. Cl. ..... 335/296; 335/306; 273/138.1; 273/138.2; 273/138.3; 40/426; 446/129; 446/131; 446/132; 446/133; 446/134; 446/135; 446/139

[58] Field of Search ..... 273/138.1, 138.2, 273/138.3, 138.4; 335/296–306; 40/426; 446/129, 131–136; 310/1, 90.5, 103

[56] References Cited

U.S. PATENT DOCUMENTS 3,861,685 1/1975 Trbovich ..... 273/138 R 4,828,264 5/1989 Rutigliano ..... 273/138 R

*Primary Examiner*—Michael L. Gellner
*Assistant Examiner*—Raymond Barrera
*Attorney, Agent, or Firm*—Gray Cary Ware & Freidenrich LLP

[57] ABSTRACT

A device for displaying the loose coupling between magnetic fields is provided, comprising a first disk having a plurality of magnetic elements attached to the first disk so that the magnetic field of said magnets extend radially from an outer edge of the first disk, a second disk having a plurality of magnetic elements attached to the second disk so that the magnetic field of said magnets extend radially from an outer edge of the second disk so that the magnets on the disks are loosely coupled to each other, the strength of the loose coupling depending on the orientation of the magnets with respect to each other, and a rotatable control member having a magnetic element attached to an end of the control member, the control member magnet being rotated to a first position such that a predetermined pole of the control member magnet is located adjacent to the magnets on said first disk causing a magnetic coupling of the magnet on said control member to the magnets on said first so that loose coupling and the chaotic motion of the first and second disks are demonstrated.

8 Claims, 11 Drawing Sheets

APPARATUS FOR DISPLAYING THE INTERACTIONS BETWEEN MAGNETIC FIELDS

This application is a continuation-in-part of U.S. patent application Ser. No. 08/790,538 filed on Jan. 30, 1997 which issued as U.S. Pat. No. 5,886,608.

BACKGROUND OF THE INVENTION

This invention relates generally to an apparatus for displaying the interaction between otherwise invisible physical phenomena, and in particular to an apparatus for displaying the loose coupling between magnetic fields.

Certain everyday physical phenomena characteristics of our environment, such as radio waves, electric fields or magnetic fields, are invisible forces that affect our lives. A person may not actually feel that effect of these physical phenomena that are governed by scientific principles. However, they have a profound effect on our lives and their understanding is necessary to a full understanding of our environment as well as our ability to take advantage of that environment. For example, radio waves permit people to communicate with each other as well as provide entertainment. For example, microwaves may be used to cook food. It is desirable for a person to be educated about these physical phenomena so that the person understands the utility, limitations and dangers of these physical phenomena. In addition, a person may be educated about the science behind these physical phenomena and become more interested in science. In order for a person to understand these physical phenomena, it is desirable for the person to be able to view the effects of these physical phenomena because people are usually more able to understand things that can be seen. For a phenomena known as a loose coupling, as described below, between magnetic objects, for example, it is desirable for teaching purposes that the person is able to view and control the effects of the loose coupling between the two magnetic objects in a repeatable manner. It is also desirable for a person to manipulate a device that displays the loose coupling between magnetic fields to achieve a goal because the achievement of the goal will necessarily cause the person to learn about and understand magnetic coupling.

Loose magnetic coupling is the phenomena wherein a first magnetic object may move another magnetic object due to the interaction of the magnetic fields of the objects. However, the first magnetic object may be moved too quickly which breaks the magnetic coupling of the objects and the other magnetic object may stop moving or reverse direction because, for example, the moment of inertia of the object overcame the loose coupling and the loose coupling was broken. Thus, a loose magnetic coupling is not a physical connection, such as a gear with teeth, and may be momentarily broken. The motion of the magnetic objects after the coupling is broken may be known as chaotic motion because a movement of the first magnetic object may not control the other magnetic object to move and the motion of each object becomes unpredictable. Chaotic motion may also occur when a magnetic object is subjected to several magnetic fields during a period of time which causes the magnetic object to react to each of these magnetic fields so that the motion of the object becomes unpredictable and chaotic.

To view the interaction of two magnetic objects, a person could place two magnets near each other and view the effect of moving the magnets closer and farther from each other. However, this is not the most appropriate teaching device.

While it may illustrate the phenomena of magnetism, it does not promote an understanding of the coupling between magnets nor the chaotic motion that may occur due to the coupling between the magnets. In addition, the effect of a static magnetic field on the motion of an object that may have magnets embedded within the object is also not demonstrated.

Another known apparatus for displaying the interaction of magnetic objects has several different devices that each displayed certain forms of the interaction between magnetic fields. This apparatus had devices that displayed the interaction of magnetic fields produced by magnetic objects, such as magnets, but not all of the devices showed the chaotic motion or the energy transfer that is caused by the interaction between the magnetic fields. In addition, many of the devices do not maintain a user's interest so that a user is unlikely to use the device for any period of time and lose any interest. The interest of the user may be maintained if there was a goal that the user could obtain only through repeated use of the device and a good understanding of the energy transfer that occurs due to the magnetic coupling so that the user may gain a greater understanding of the energy transfer that occurs between magnetic objects in attempting to attain the goal. However, known apparatuses do not provide a goal to the user and do not maintain the interest of the user.

Thus, there is a need for an improved apparatus for displaying the interactions between magnetic fields which avoid these and other problems of known devices, and it is to this end that the present invention is directed.

SUMMARY OF THE INVENTION

The invention provides an apparatus that enables a plurality of people to each interact with a device which demonstrates the effects of the interaction between magnetic objects displayed by each device. In particular, the device may show the loose coupling of two magnetic objects and the chaotic motion may occur when the magnets are loosely coupled. The invention provides a plurality of different devices, each of which may be separately manipulated by a separate user, to display chaotic motion, resonance and the energy transfer caused by the interaction of magnetic fields. Each device may be visually different, but each device permits a user of the device to see the energy transfer caused by the magnetic interaction of the magnetic objects in the device. Each of the devices may also have a goal that the user may obtain only through repeated use of the device by the user thereby promoting a good understanding by the user of the effects of the interaction between magnetic fields. Due to the goal, each device may cause the user to learn about the energy transfer caused by the magnetic field interaction without the user realizing that the learning has occurred because the user is focused on attaining the goal.

The invention also provides a device for displaying the loose coupling of magnetic fields through the use of a pair of disks that are located adjacent each other. Each disk may have magnets attached thereto so that the magnets on one disk may be loosely coupled magnetically to the magnets on the second disk. A control knob may be loosely magnetically coupled to the magnets on either of the disks to permit a user to move the disks. The disks may demonstrate chaotic motion and the effect of a static magnetic field (the control rod magnet) on the motion of the objects (the disks) due to the interaction between magnetic fields.

In accordance with another embodiment of the invention, a case is provided into which one or more removable panels containing a different magnetic device may be placed so that the actual magnetic devices in the case may be easily changed. One of the magnetic devices connected to a removable panel is a probability distribution device in which a plurality of balls may be released from a predetermined height and distributed across a bottom portion of the device.

In accordance with the invention, a device for displaying the loose coupling between magnetic fields is provided, comprising a first disk having a plurality of magnetic elements attached to the first disk so that the magnetic field of said magnets extend radially from an outer edge of the first disk, a second disk having a plurality of magnetic elements attached to the second disk so that the magnetic field of said magnets extend radially from an outer edge of the second disk so that the magnets on the disks are loosely coupled to each other, the strength of the loose coupling depending on the orientation of the magnets with respect to each other, and a rotatable control member having a magnetic element attached to an end of the control member, the control member magnet being rotated to a first position such that a predetermined pole of the control member magnet is located adjacent to the magnets on said first disk causing a magnetic coupling of the magnet on said control member to the magnets on said first so that loose coupling and the chaotic motion of the first and second disks are demonstrated.

DETAILED DESCRIPTION OF A PREFERRED EMBODIMENT

The invention is particularly applicable to a teaching (or educational) apparatus for displaying the loose coupling between magnetic fields and the chaotic motion caused by the loose coupling to a plurality of people. It is in this context that the invention will be described. It will be appreciated, however, that the system and method in accordance with the invention has greater utility.

Figure 1:
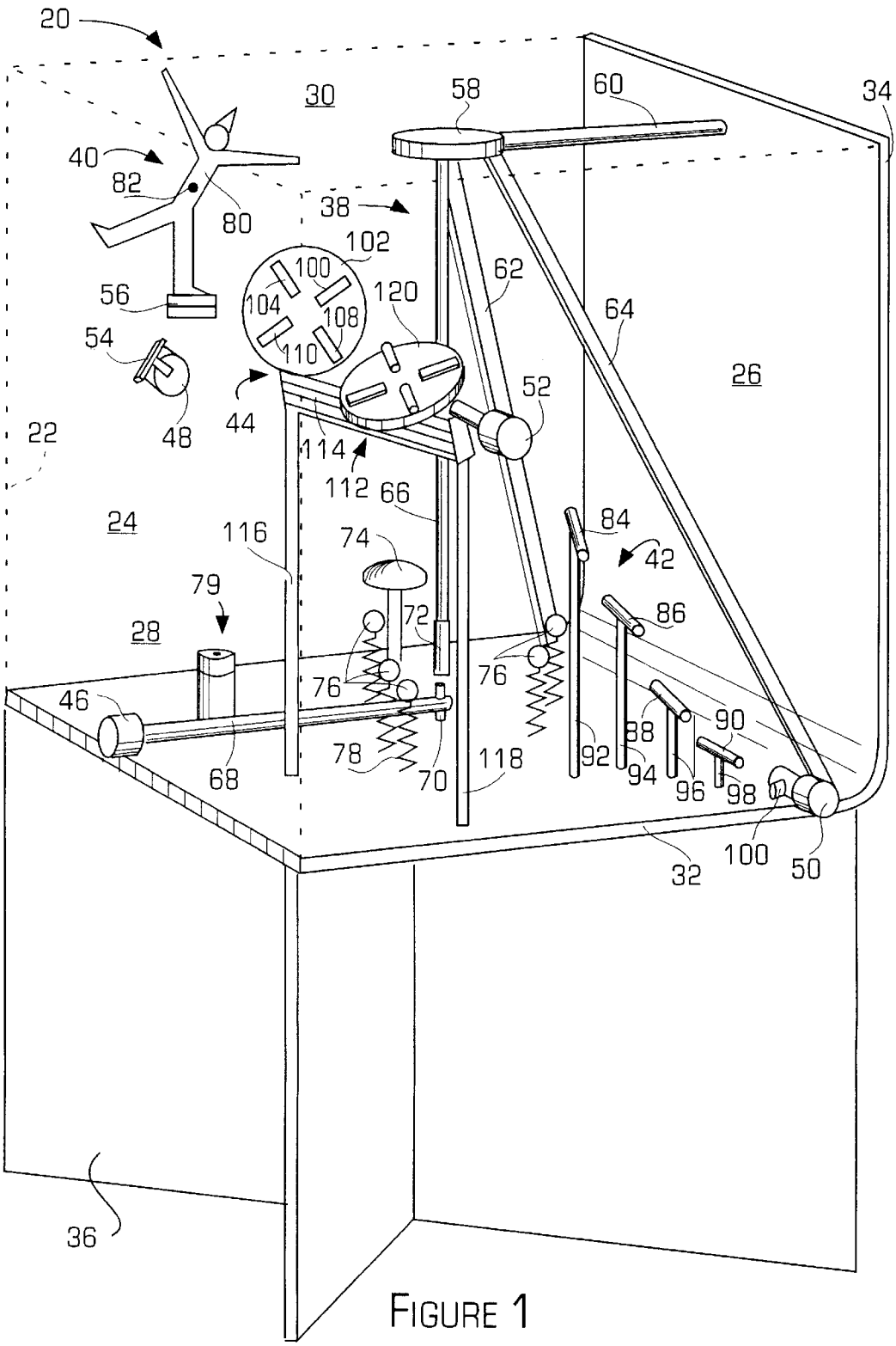
FIG. 1 is a perspective view of an apparatus for displaying the interaction of magnetic objects in accordance with the invention.
Figure 2:
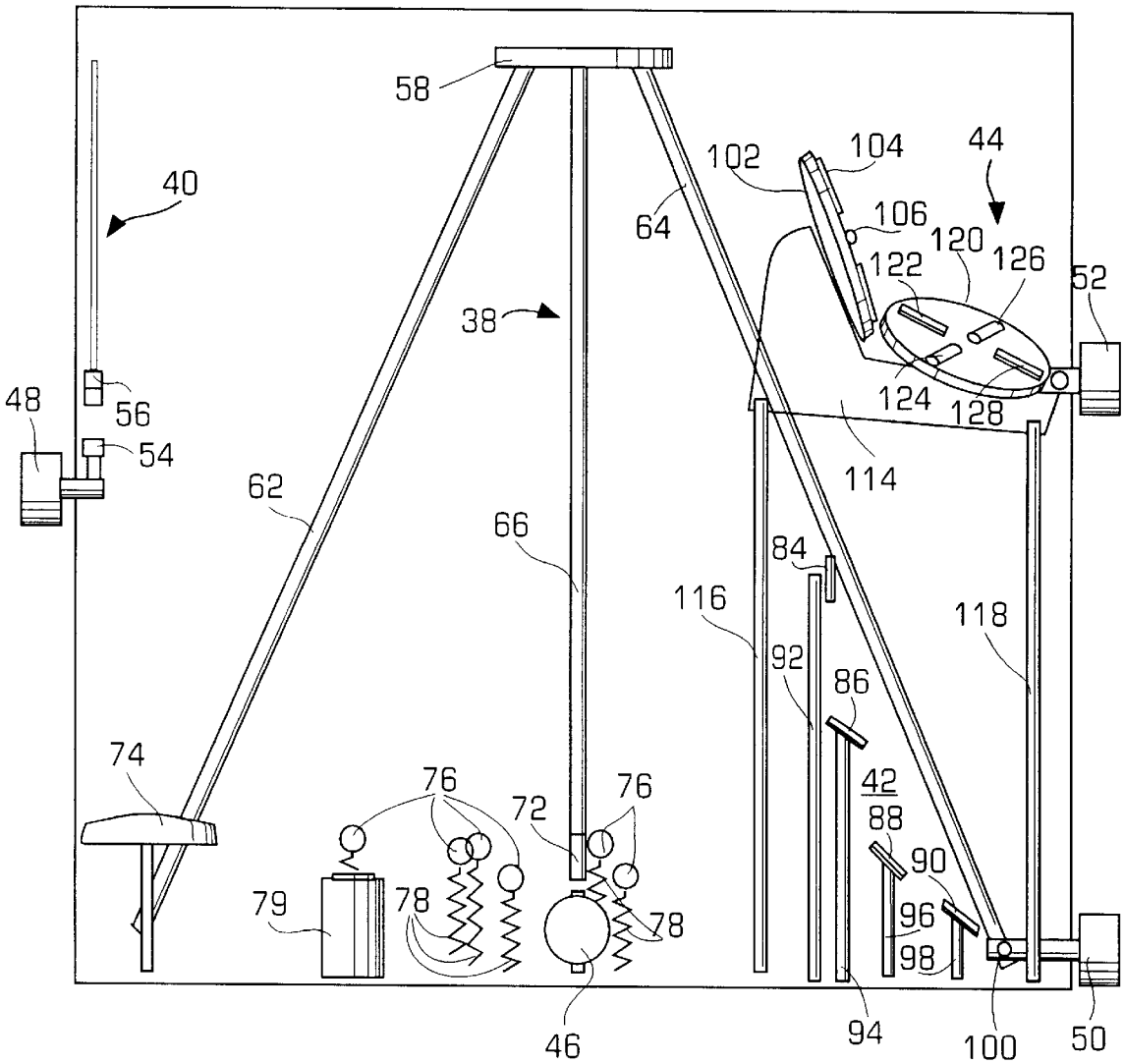
FIG. 2 is a front view of the apparatus for displaying the interaction of magnetic objects of FIG. 1.
Figure 3:
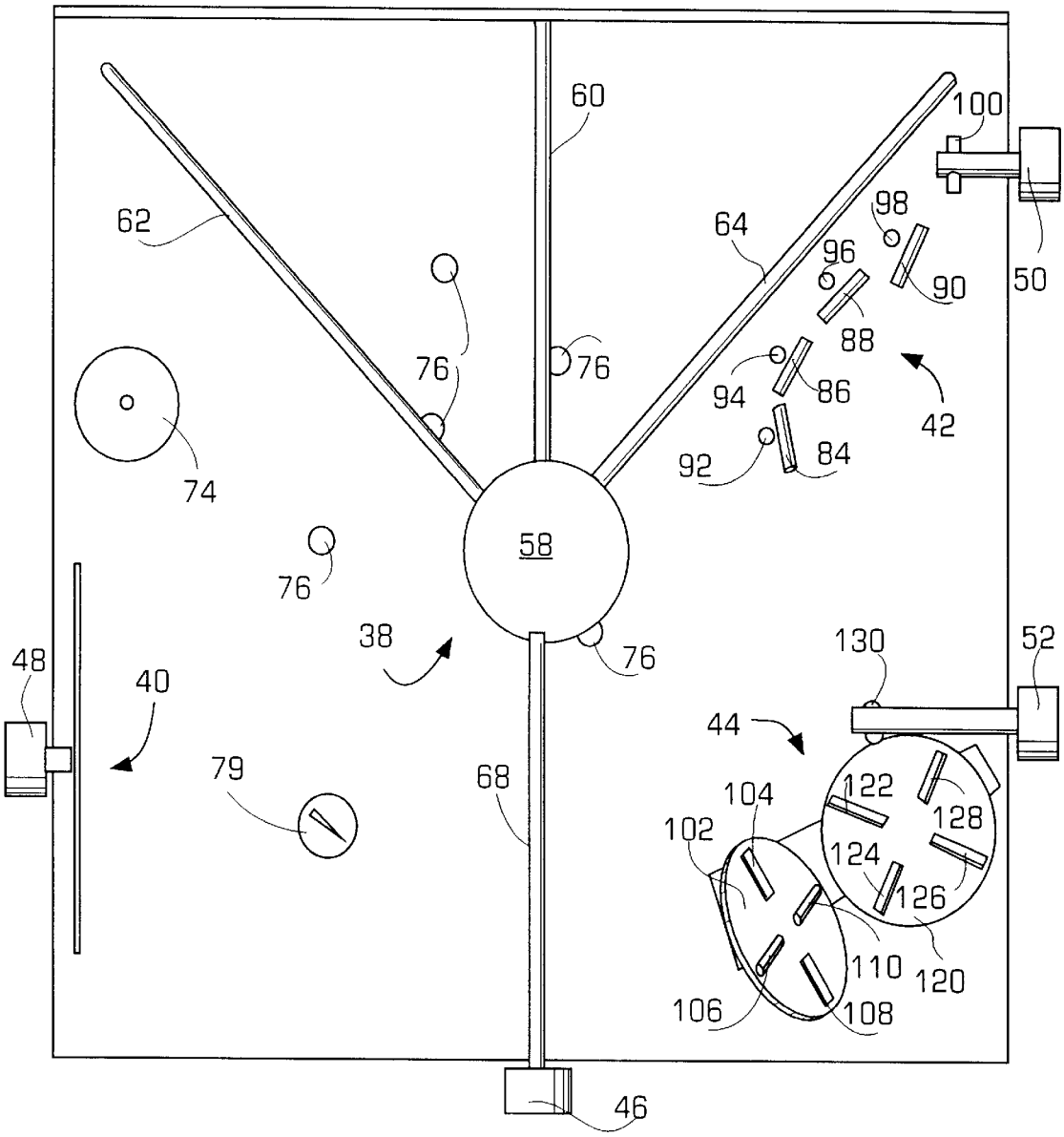
FIG. 3 is a top view of the apparatus of FIG. 1.

FIGS. 1, 2 and 3 are a perspective view, a front view, and a top view, respectively, of an apparatus 20 for displaying the interaction between magnetic fields to a plurality of people. The apparatus may have a generally rectangular shaped housing 22, that may be shaped, for example, like a cube. The housing may have a front side 24, a left side 26, a right side 28 and a top side 30 that may be manufactured out of a clear material, such as plastic, so that a person near the apparatus may view the interactions of magnetic fields within the housing. A bottom side 32 and a back side 34 may be opaque to provide people with a background against which to view the devices within the housing. The housing may be supported by a stand 36 that may have, for example, a cross-shape.

Within the housing, there are several devices that display the loose coupling of magnetic fields in accordance with the invention. Each device will be briefly described now, and then described in more detail below. The housing may include a pendulum assembly 38, a FIG. 40, such as a clown, a set of flippers 42, and a pair of loosely coupled disks 44 that each may demonstrate the loose coupling between magnetic objects and the chaotic motion that may occur due to the loose coupling. The magnetic objects are loosely coupled together because the connection between the magnetic objects is not firm, such as a gear, and may be broken due to rapid movement of the magnetic objects. Due to this loose coupling, the magnetic object may not necessary move in unison with each other, which is known as chaotic motion since it can not be precisely predicted. The loose coupling of the magnetic objects and the chaotic motion caused by this loose coupling may be demonstrated by each of the devices within the housing as described in more detail below.

The pendulum assembly 38 may include a platform 58, that may be circular and may be located near the top side 30 of the housing. The platform may be attached to the opaque back side 26 by a support member 60, that may be a circular rod. The pendulum may also have a second support member 62 and a third support member 64, that may also be circular rods both attached to the platform 58 and the bottom surface 32 to support the platform. The pendulum may also have a pendulum member 66 that may be suspended from the platform 58 so that the pendulum member may swing in any direction. The pendulum may have the control knob 46 that may have a member 68 connected to it that may be in turn connected to a control magnet 70. The control magnet may be rotated by turning the control knob 46. The pendulum member 66 may have a magnet 72 that may be located at the end of the pendulum member, in close proximity to, but not touching the magnet 70 of the control knob 46. The magnetic coupling of the magnet of the control knob and the magnet of the pendulum to control the chaotic movement of the pendulum will be described below with reference to FIG. 5. The pendulum assembly may maintain a user's interest by providing several goals that may be achieved by the user. For example, the pendulum assembly may also have a bell 74 that may be struck by the end of the pendulum if the pendulum is swung a sufficiently large amount using the loose coupling of the control knob magnet to the pendulum magnet. The ringing of the bell may provide the user with a goal which requires accurate control of the pendulum. The pendulum assembly may also have a plurality of balls 76 mounted on springs 78. Each ball may have a magnet (not shown) located within the center of the ball that may interact with the pendulum magnet, as described below with reference to FIG. 4. The pendulum may also have a compass 79 that may be affected by the magnetic field of the magnet in the pendulum. The bell, the balls, and the compass each provide a different response when the pendulum is in close proximity to that object. The FIG. 40, such as a clown, will now be briefly described.

The FIG. 40, that may be a clown, may have a clown body 80 that may rotate about an axle 82 that is attached to the housing. One foot of the clown body may have a magnet 56 attached to it, and the control knob 48 may have a magnet 54 attached to it so that as the control knob is turned, the magnet on the knob is moved near and loosely couples to the magnet on the clown which may cause the clown body to rotate about the axle as described below with reference to FIG. 7. The set of flippers 42 may have a first magnet 84, a second magnet 86, a third magnet 88 and a fourth magnet 90 rotatably mounted on adjacent support members 92, 94, 96, 98. The control knob 50 may have a magnet 100 attached to it that magnetically loosely couples with the fourth magnet 90 and the set of flippers, as described below with reference to FIG. 6. Now, the pair of loosely coupled disks 44 will be described.

The disks may have a first disk 102 that may have a plurality of magnetic objects 104, 106, 108, 110, such as bar magnets attached to the disk such that the magnetic fields of the magnetic objects are directed radially outwards. The first disk may be rotatably mounted on a support system 112 that may include a platform 114, a first support 116 and a second support 118. A second disk 120 may also have a plurality of magnetic objects 122, 124, 126, 128 attached to it. In a preferred embodiment, the magnetic objects may be attached to the first and second disks at possibly fixed intervals along the radii of the first disk so that a pole of the magnetic object is located near the outer edge of the first and second disks. The position of the magnetic objects may permit the loose coupling the magnetic objects on the disks with each other. Although four magnets are shown for each disk, the invention is not limited to any particular number of magnets attached to the disks. In a preferred embodiment, the disks may each be mounted in a plane adjacent to each other, wherein the two planes may be at a predetermined angle with respect to each other. The adjacent mounting of the two disks causes the magnets to loosely couple with each other which in turn causes the chaotic motion of the disks. The control knob 52 for the disks may have a magnet 130 attached to the end of the control rod that magnetically loosely couples to the disks as described in more detail with reference to FIGS. 8,9,10,11. Each of these devices provide a user with a different visual display of the effects of the interaction between magnetic objects. As described below, the clown may rotate, the pendulum may be swung, the disks may rotate or the flippers may flip due to a magnetic interaction.

The invention, however, is not limited to these devices and may have fewer or more devices. In the embodiment shown, a person may interactively control each of these devices separately to view the effects of the loose coupling of magnetic fields, as described above. The interactive control of a device permits a user create a condition and to receive visual feedback corresponding to changes in the device created by the users. The control also permits a user to play with the device and further learn about the effects of the loose coupling of magnetic fields and the chaotic motion caused by the loose coupling. As described above, each device may have a goal to be attained by the user which further increases a user's desire to master the control of the device which also necessarily requires a good understanding of the effects of the interaction between magnetic objects. For a person to interactively control each of these devices, a control knob 46, 48, 50, 52 is attached to the housing 22 and also magnetically loosely coupled by a magnet, as described below, to each of the devices. The control knobs may be placed at different sides of the housing to permit each device to be simultaneously controlled. The devices have also been positioned in the housing so they do not interfere with each other.

For each device, the control knob is magnetically loosely coupled to the device so that a movement of the control knob may move the device due to the magnetic loose coupling between the control knob and the device. The basic interaction between magnetic objects will be briefly described. If a north pole of a magnet is moved close to another north pole, there is a repulsive force generated which attempts to separate the two north poles. The same repulsive force occurs between two south poles. For a north pole moved close to a south pole, or vice-versa, an attractive force is generated.

The apparatus in accordance with the invention permits a plurality of people to interactively change the loose coupling between magnetic fields and view that change through physical motion that may be viewed, such as the rotating of the clown. The strength of the magnetic loose coupling may vary depending on the particular orientation of the magnets with respect to each other and the distance between them. Each of the devices within the apparatus provides a slightly different display of the effect of the interaction of magnetic fields. Each device also provides a different type of interactivity that may appeal to different people. The details of the interaction of the control knobs with the device will be described in more detail below. Now, the magnetic interaction between the pendulum member and the balls will be described.

Figure 4:
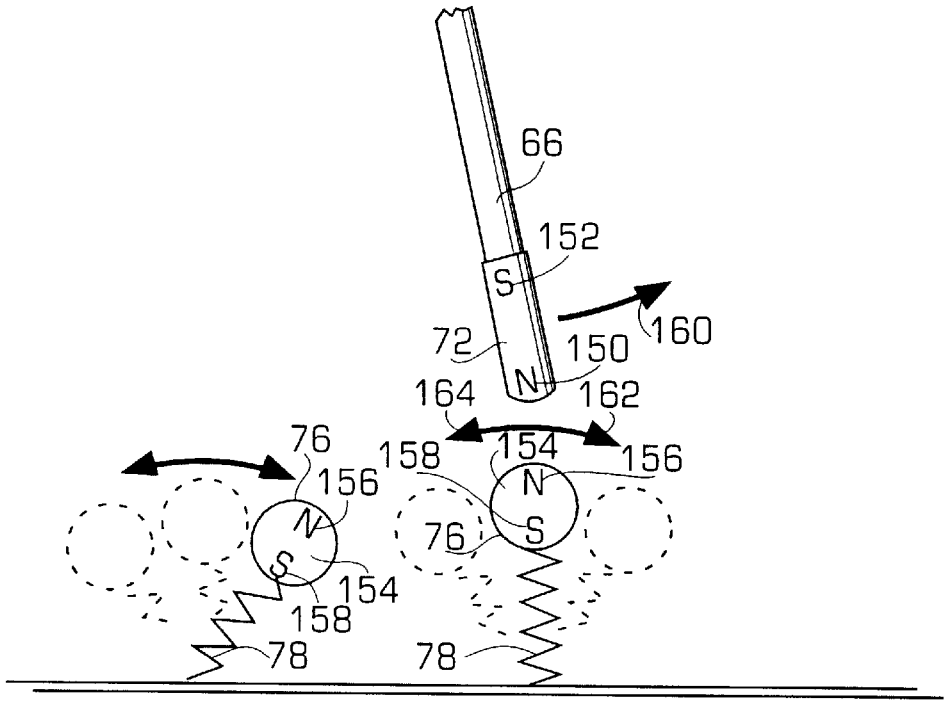
FIG. 4 is a close-up view of an end portion of the chaotic pendulum, shown in FIG. 1, interacting with a magnetic object.

FIG. 4 is a diagram illustrating the interaction of the pendulum member 66 with the balls 76 in accordance with the invention. The pendulum member may have the magnet 72 attached to the end of the pendulum member and the magnet may have a first pole 150 and a second pole 152 that are at opposite ends of the magnet. In this example, the north pole of the magnet is at the end of the pendulum member. The balls 76, attached to the springs, may have a magnetic center 154 with a first pole 156 and a second pole 158. In this example, the north pole is located near the top of the ball so that as the pendulum member moves in a direction shown by an arrow 160, the ball move in a first direction 162 as the pendulum is moving towards the ball and then in a second direction 164 when the pendulum member has moved past the ball due to the force of the spring 78. The ball moves in the first direction due to the magnetic repulsive forces between the north poles of the pendulum member and the ball. The invention may also be implemented by causing the south poles of two magnets to be in close proximity to each other. Therefore, the magnetic repulsion between the pendulum member and the ball, in accordance with the invention, is caused by two like poles of two different magnets being in close proximity to each other. As shown, another ball 76 may also be influenced by the magnet attached to the pendulum member.

The magnets on the pendulum member and the plurality of magnets in the balls interact and couple with each other so that the pendulum member may be may be subjected to a plurality of magnetic fields. The interaction of these magnetic fields may cause the pendulum to react to each of these magnetic fields and exhibit chaotic motion because the pendulum may move in an unpredictable manner. Now, the magnetic loose coupling between the pendulum control rod 68 and the pendulum member will be described.

Figure 5A:
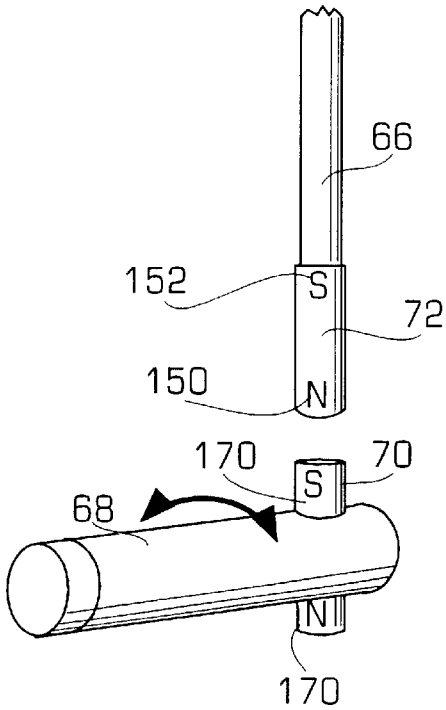
FIG. 5A is a close-up perspective view of the end portion of the chaotic pendulum and the control rod of FIG. 1.
Figure 5B:
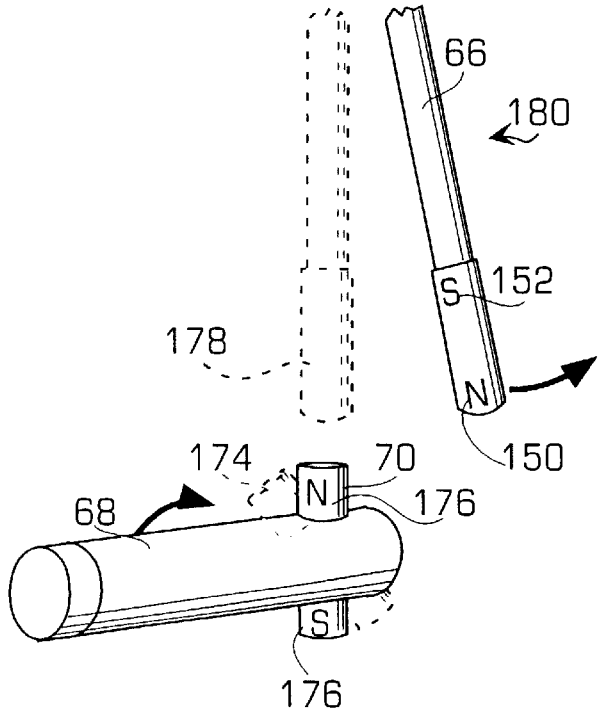
FIG. 5B is another close-up perspective view of the end portion of the chaotic pendulum and the control rod while the control rod is being moved.

FIGS. 5A and 5B are perspective views showing the loose coupling between the pendulum member 66 and the control rod 68. As described above, the pendulum member has the magnet 72 with a first and second pole 150, 152. The control rod may also have the magnet 70 that may have a first pole 170, that may be a south pole, and a second pole 172, that may be a north pole. The control rod may be rotated so that the pole of the magnet 70 facing up changes. As shown in FIG. 5A, when the south pole 170 of the control rod magnet is upwards, the south pole of the control rod magnet is loosely coupled to and attracts the north pole 150 of the pendulum member magnet 72 because opposite magnetic poles (i.e., N-S or S-N) of two magnets attract. The strength of this magnetic coupling varies depending on the distance between the magnets. As shown in FIG. 5B, the control rod magnet may be in a first position 174, shown in phantom, in which the north pole of the magnet is almost vertical. Then as the control rod is rotated, the magnet 70 moves to a second position 176 in which the north pole is vertical and closer to the pendulum magnet 72 so that the loose coupling of the magnets is increased. The movement of the control rod, due to the loose coupling, causes the pendulum member to move from a first position 178, shown in phantom, to a second position 180. Thus, in operation, the control rod and the control rod magnet permits a person rotating the control knob to loosely couple to the pendulum and swing the pendulum using the forces between the magnets. As described above, the loose coupling between the magnets may cause the control knob to rotate, but the pendulum may not swing because the loose coupling between the magnets may be broken. The user may learn to direct the movement of the pendulum by observing the chaotic motion and energy transfer of the pendulum and the balls in order to strike and move close to various objects, such as the bell 74, the balls 76, or the compass 79, as shown in FIGS. 1,2 and 3. This goal may cause a user to repeatedly use the pendulum. Now, the details of the set of flippers will be described.

Figure 6:
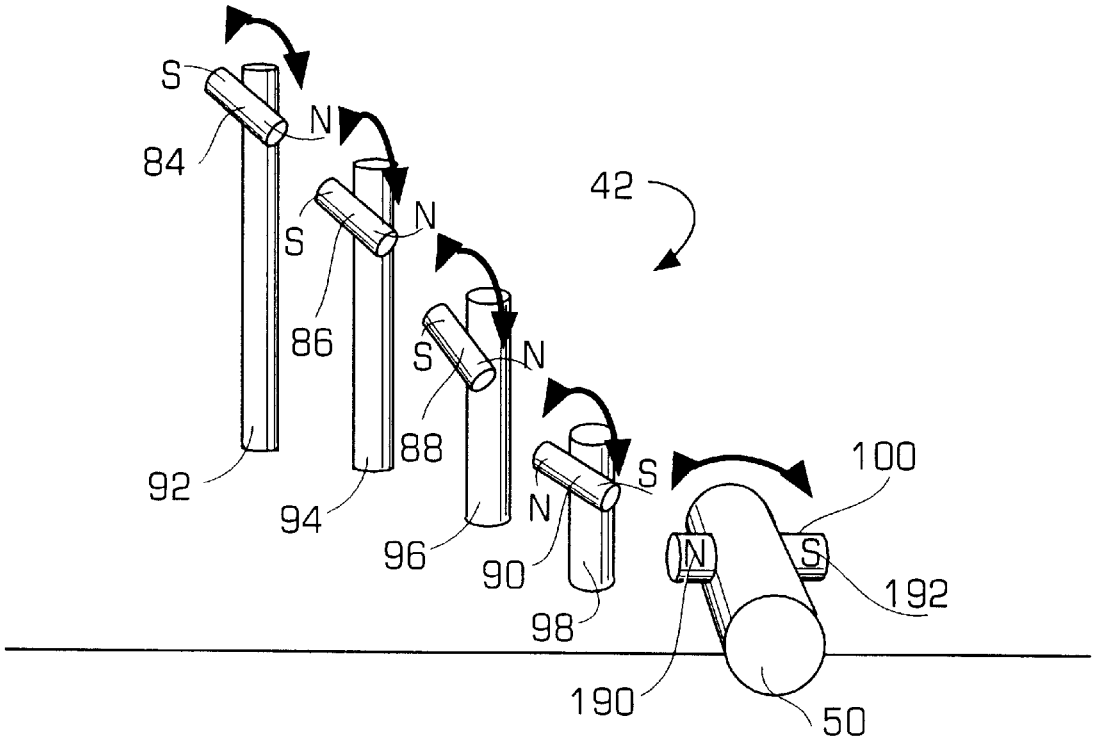
FIG. 6 is a perspective view of a set of flippers that are part of the apparatus of FIG. 1.

FIG. 6 is a perspective view of the set of flippers 42 that may have a plurality of magnets 84, 86, 88, 90 attached to a plurality of support members 92, 94, 96, 98, and the control knob 50 that may rotate the magnet 100 attached to the end of the control knob. In operation, as the magnet 100 is turned so that a first pole 190, that may be a north pole or a second pole 192, that may be a south pole, are brought into close proximity of the first magnet 90, the loose coupling between the poles of the first magnet, which is rotatably attached to the support member 98, and the control magnet may cause the first magnet to rotate. The motion of the first magnet and the poles of the magnet may in turn cause the second magnet 88 to rotate which in turn may cause the third magnet to rotate and so on. This creates a chain reaction in which a user rotating the control knob may rotate each magnet within the set of flippers due to loose coupling. Now, the FIG. 40, that may be a clown, will be described.

Figure 7:
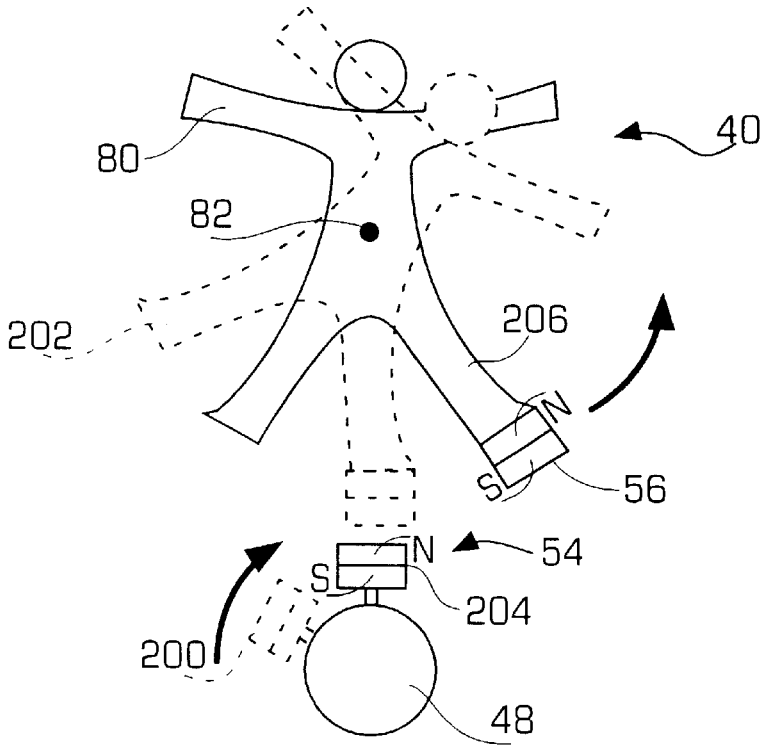
FIG. 7 is a side view of a clown that is part of the apparatus of FIG. 1.

FIG. 7 is a front view of the clown 40 that may have the clown body 80, the axle 82, and the magnet 56 attached to the foot of the clown. The clown control knob 48 may also have the magnet 54 attached to its end so that it can interact and couple with the magnet attached to the clown. In a first position 200, shown in phantom, the north pole of the control knob magnet is not close to the clown and the clown is in a first position 202, also shown in phantom. As the control knob is rotated and the magnet 54 is moved to a second position 204 in close proximity to the magnet 56, the magnet 56 is attracted and coupled to the magnet 54 and the motion of the magnet 54 causes the clown magnet 56 to move and moves the clown to a second position 206. Thus, a person may rotate the clown due to the coupling of the magnet 54 with the magnet 56 and without any actual contact with the clown body. If a user rotates the control knob at a proper speed, the user may cause the clown to rotate completely around. If the user rotates the control knob too quickly, the loose coupling between the magnets may be broken and the clown will not rotate. Now, the loosely coupled disks 44 will be described.

Figure 8:
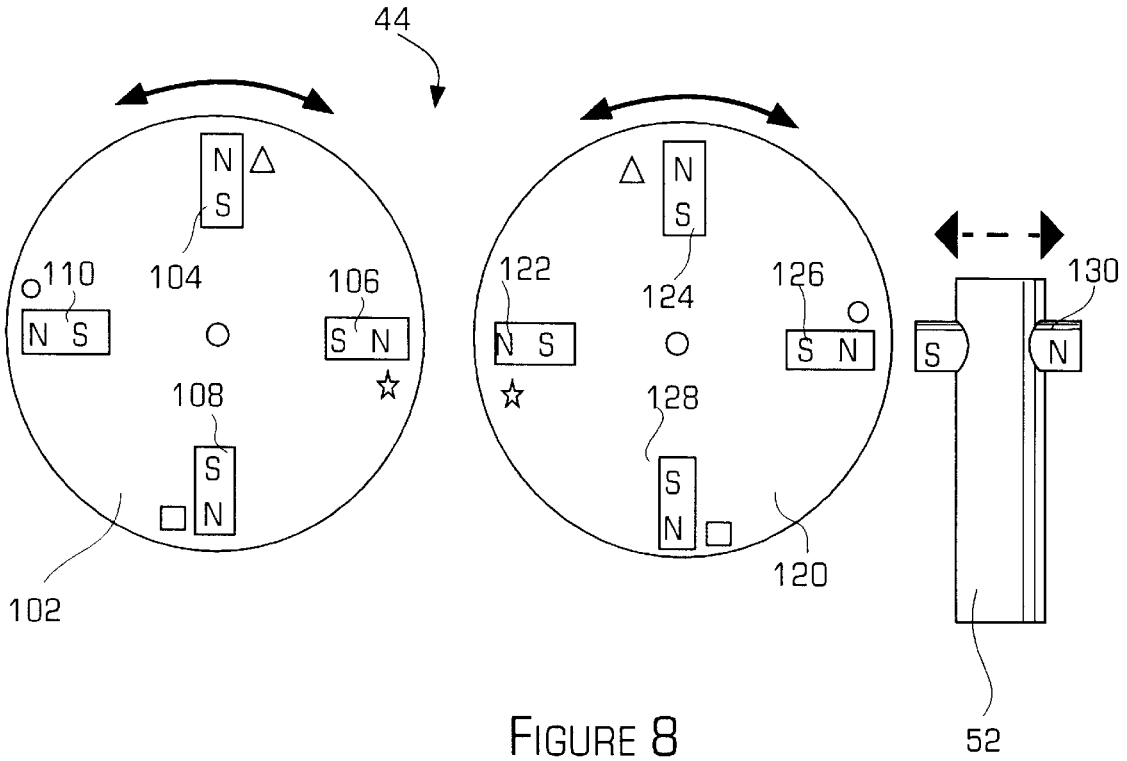
FIG. 8 is a top view of the magnetically coupled disks that are part of the apparatus shown in FIG. 1.
Figure 9:
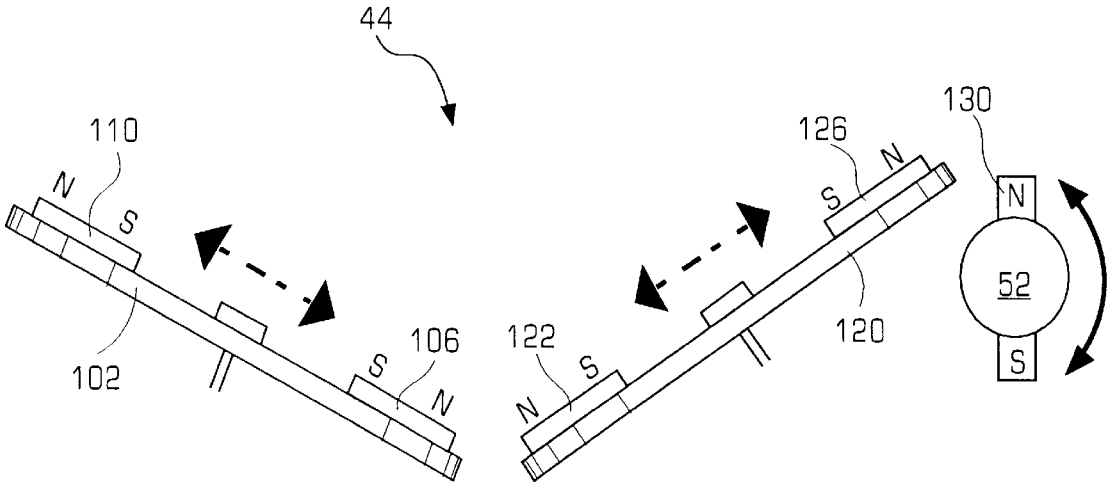
FIG. 9 is an end view of the magnetically coupled disks of FIG. 8.

FIG. 8 and 9 are a top view and a side view, respectively, of the disks 44 in accordance with the invention. The first and second disk 102, 120 may be oriented in a tilted manner with respect to each other and may be located in close proximity to each other so that the magnets on each disk may interact and magnetically couple with each other. As shown, each disk may have a plurality of magnetic objects 104–110 and 122–128, such as the four bar magnets shown in this embodiment, attached to the disk so that the magnetic fields of the objects are directed radially outwards from each disk. The magnetic objects may be attached to the disks along the radii of the disk. The invention, however, is not limited to any particular number of magnets or any particular type of magnet. The control knob 52 may have the magnet 130 located at the end of the control knob that may be loosely coupled to the first disk. As the control knob is rotated, the magnetic coupling between the magnet on the control knob and the magnet on the second disk 120 may cause the second disk to rotate which in turn causes the first disk 102 to rotate due to the loose coupling between the disks. As described above, the loose coupling may be momentarily broken and the disks may move in a chaotic manner.

If the loose coupling is broken momentarily, the disks may move in any direction, including reversing their motion, due to the energy stored in the disk in the form of a moment of inertia. The unpredictable movement of the disks may in turn cause other magnets to couple with each other which will also effect the movement of the disks is some manner. For example, if a disk is rotated too quickly, the moment of inertia of the disk may overcome the loose coupling of the magnets and the disks will rotate unpredictable. In addition, due to the plurality of magnets attached to each disk, there may be multiple couplings between magnets that will also cause chaotic movement of the disks. Finally, the control rod magnet, which generates a static magnetic field, may affect the motion of the disks due to the interaction between the control rod magnet and the magnets attached to the disks.

Each disk may also have a corresponding set of symbols on the disks, that may be located next to each of the magnetic objects, such that a user may have a goal to attempt to align the symbols with each other which may cause the user to repeatedly rotate the disks until that goal may be obtained. The alignment of the symbols may also require the user to use the loose coupling of the disks without breaking the loose coupling. As the user attempts to attain that goal, the user will also be necessarily learning about the interaction between the magnets on the two disks and the energy transfer that may occur between the magnets due to the moment of inertia of the disks.

Figure 10:
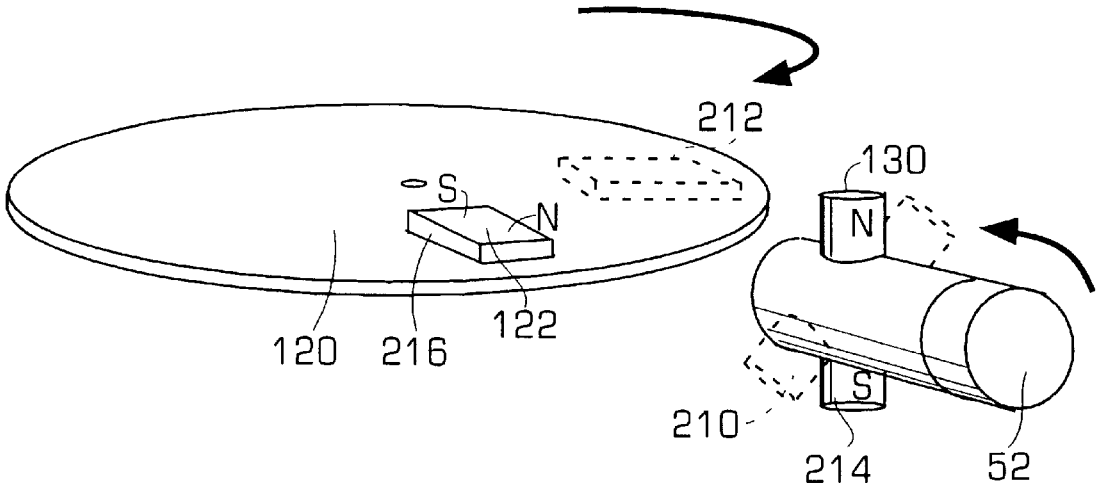
FIG. 10 is a perspective view of a magnetically coupled disk of FIG. 8 interacting with a control rod.

FIG. 10 is a perspective detailed view of the interaction between the second disk 120 and the control magnet 130 of FIGS. 8 and 9. As shown, when the control magnet 130 is in a first position 210 shown in phantom, the magnet 122 of the second disk 120 may be in a first position 212. Then, as the control magnet 130 is rotated by the rotation of the control knob to a second position 214, the north pole of the control magnet may magnetically coupled to the north pole of the disk magnet 122 and the second disk may rotate until the magnet 122 is in a second position 216, unless the loose coupling is broken and chaotic motion occurs. The disk may rotate because of the loose coupling between the control magnet to the magnet attached to the disk. Now, the interaction between the magnets attached to the two disks will be described.

Figure 11:
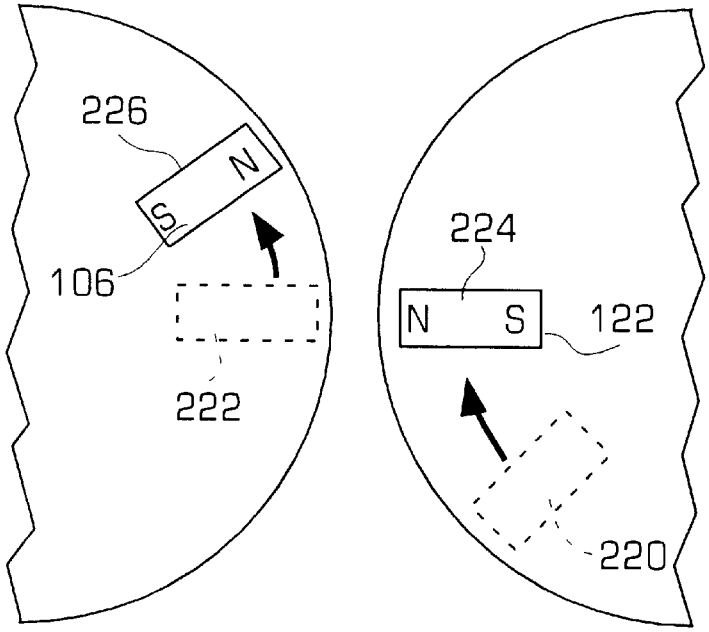
FIG. 11 is a top view of the magnetically coupled disks of FIG. 8 illustrating the magnetic coupling between the two disks.

FIG. 11 is a top view showing the interaction between the magnets on each disk in accordance with the invention. The magnet 122 on the second disk 120 may be in a first position 220 and the magnet 106 on the first disk 102 may be in a first position 222, both of which are shown in phantom. As the magnet 122 on the second disk is rotated to a second position 224, the north pole of the magnet moves adjacent to and loosely couples to the north pole of the magnet 106 causing the first disk to begin rotating due to the energy transfer between the magnets which in turn causes the magnet 106 to move to a second position 226. Thus, the magnet on the control knob, and the magnets on the disks may be loosely magnetically coupled to each other. In addition, the disks 44 provide a user with a goal so that the user may repeatedly play with the disks. Now, another embodiment of the invention will be described.

Figure 12:
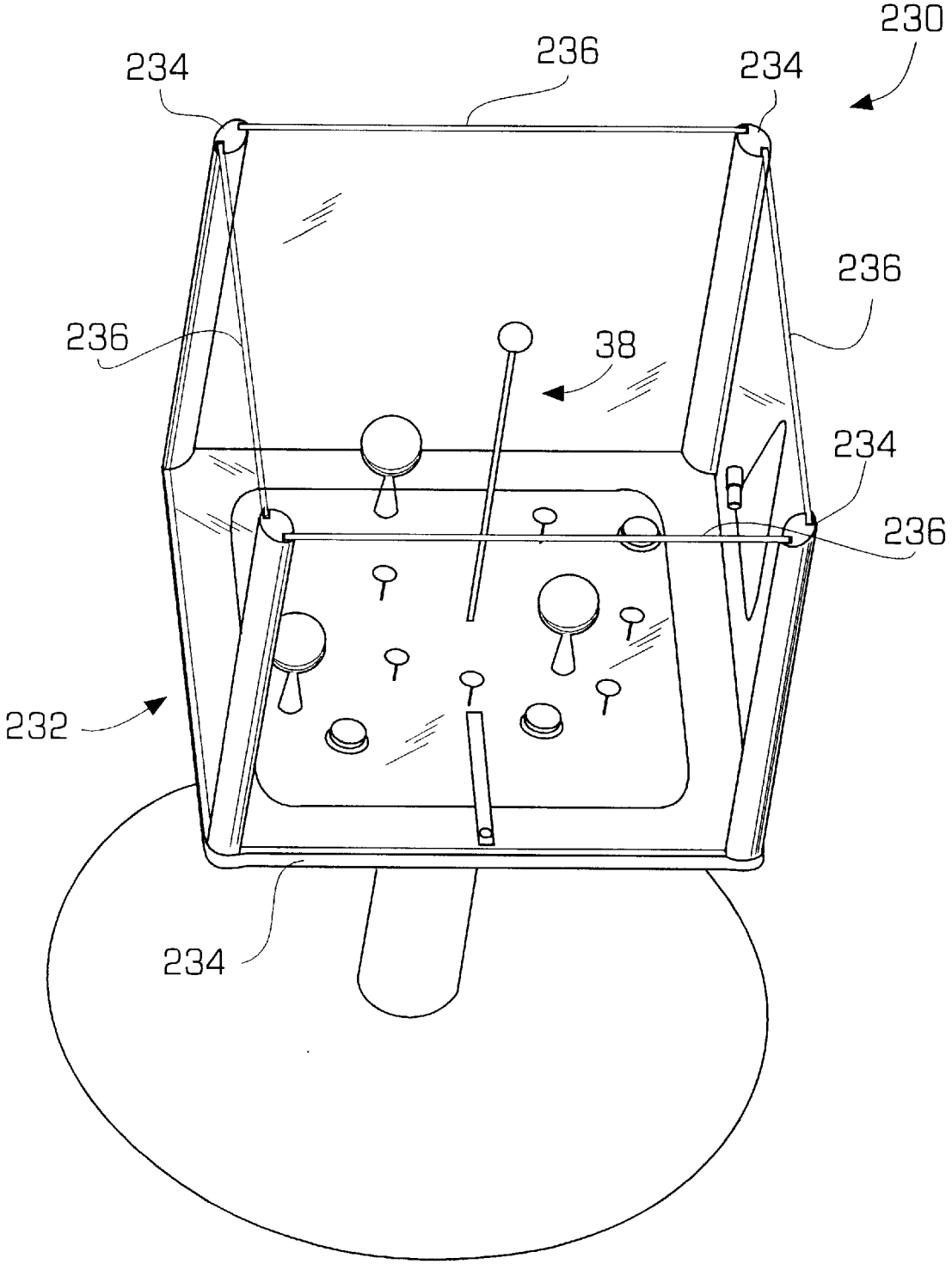
FIG. 12 is a diagram illustrating another embodiment of the apparatus for displaying the interaction of magnetic objects in accordance with the invention.

FIG. 12 is a diagram illustrating another embodiment of an apparatus 230 for displaying the interaction of magnetic objects in accordance with the invention. The apparatus includes a chassis 232 having a bottom region and one or more vertical support arms 234. The apparatus may further include one or more panels 236 which may be slid into the support arm within a channel in the support arm. The panels are removable and interchangeable so that the actual four panels in any particular apparatus may be changed easily. Each panel may comprise a different game or device for showing some property of magnetism or the interactions of magnets. For example, the clown 40, shown in FIGS. 1 and 7 and described above, may be attached to a removable panel. Another panel may contain a probability chute game which will be described below with reference to FIGS. 13–15. Each panel may be made of a transparent durable material, such as glass or plastic, so that the user of the apparatus may see into the apparatus. The combination of the chassis and the removable panels permit some of the games or devices contained in the apparatus to be changed. The apparatus 230 with the removable panels may still include the pendulum 38 as described above. Now, the probability chute game in accordance with the invention will be described.

Figure 13:
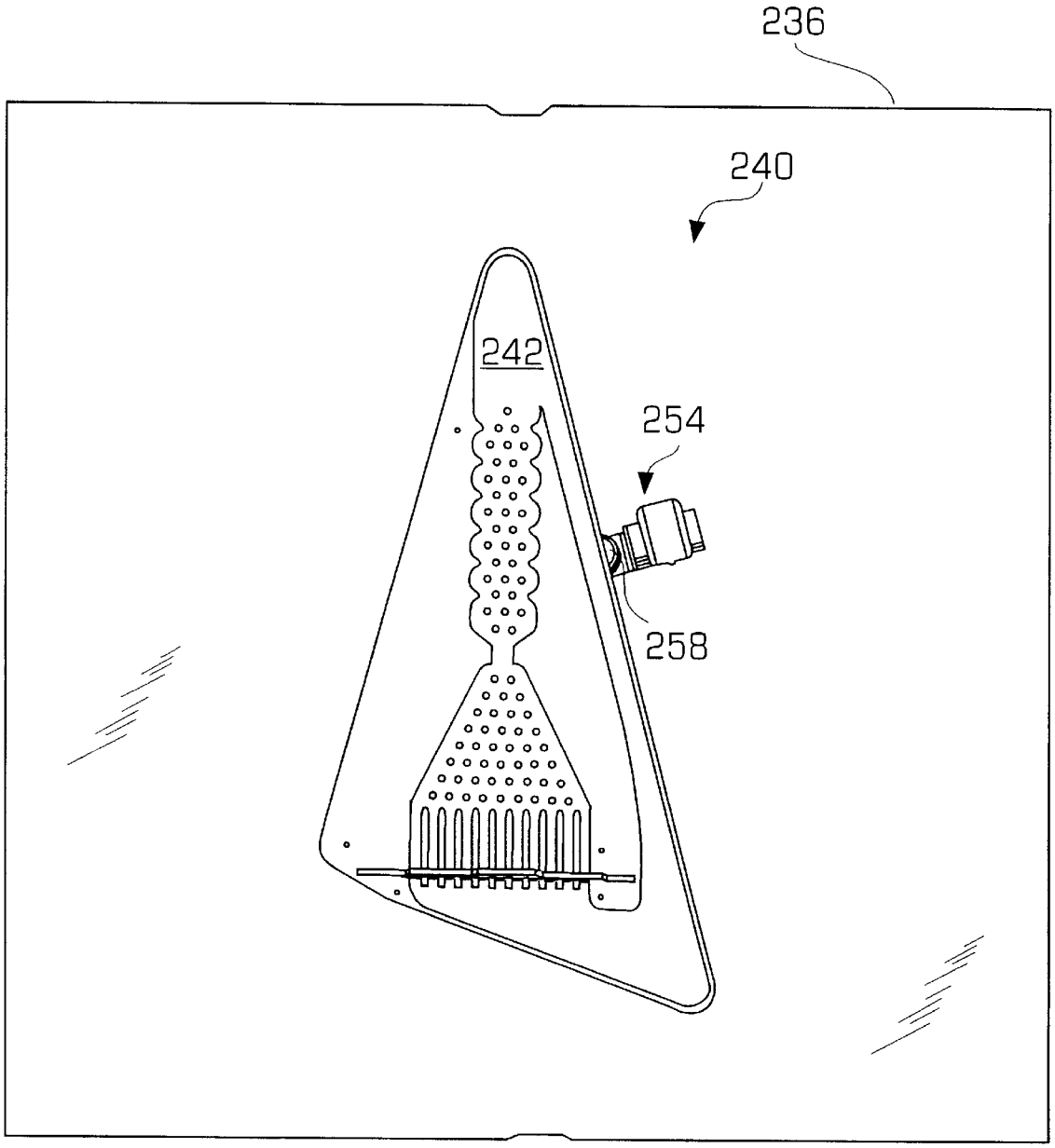
FIG. 13 is a diagram illustrating a removable panel having a probability game in accordance with the invention.
Figure 14:
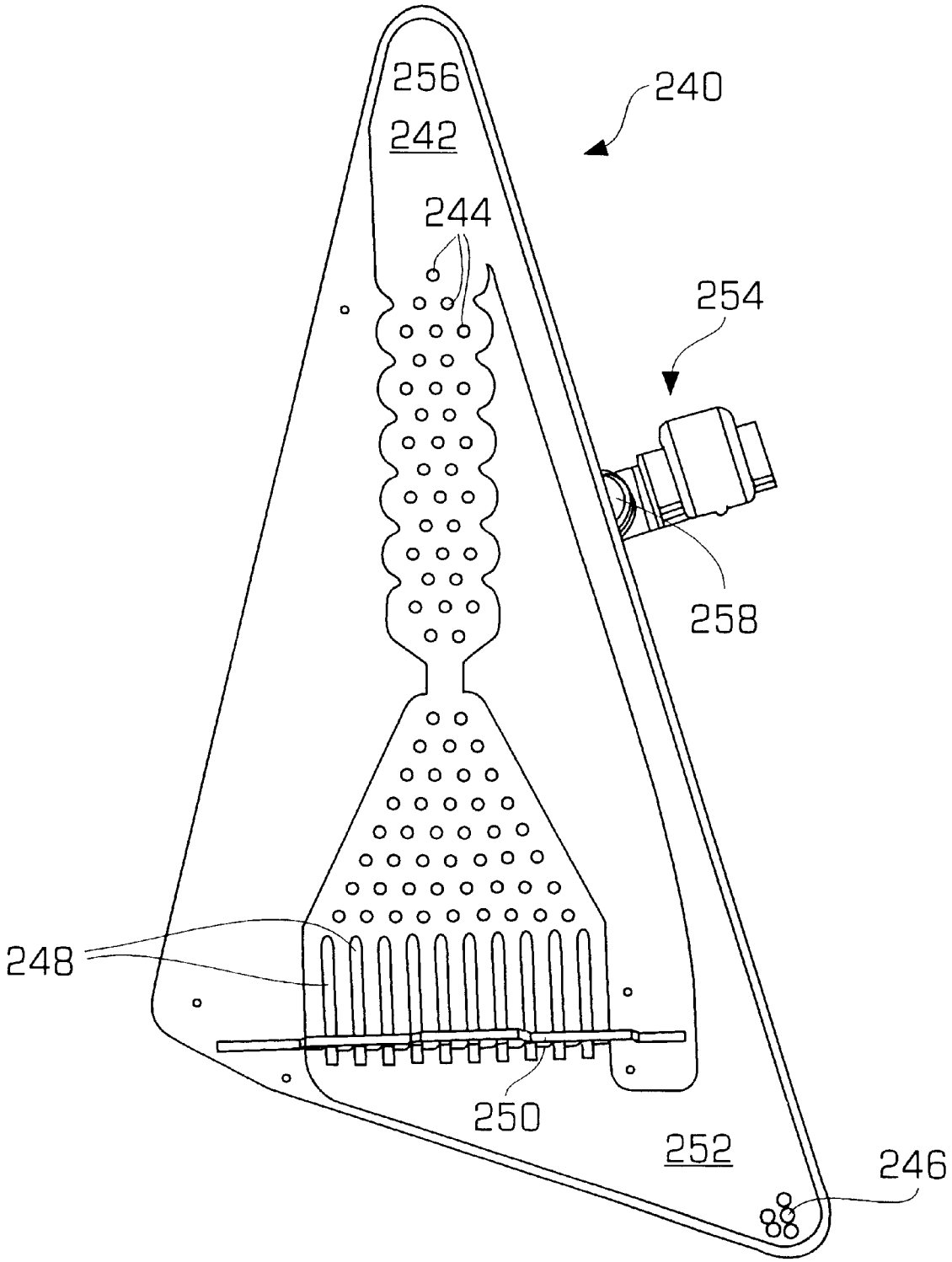
FIG. 14 is front view of the probability game.
Figure 15:
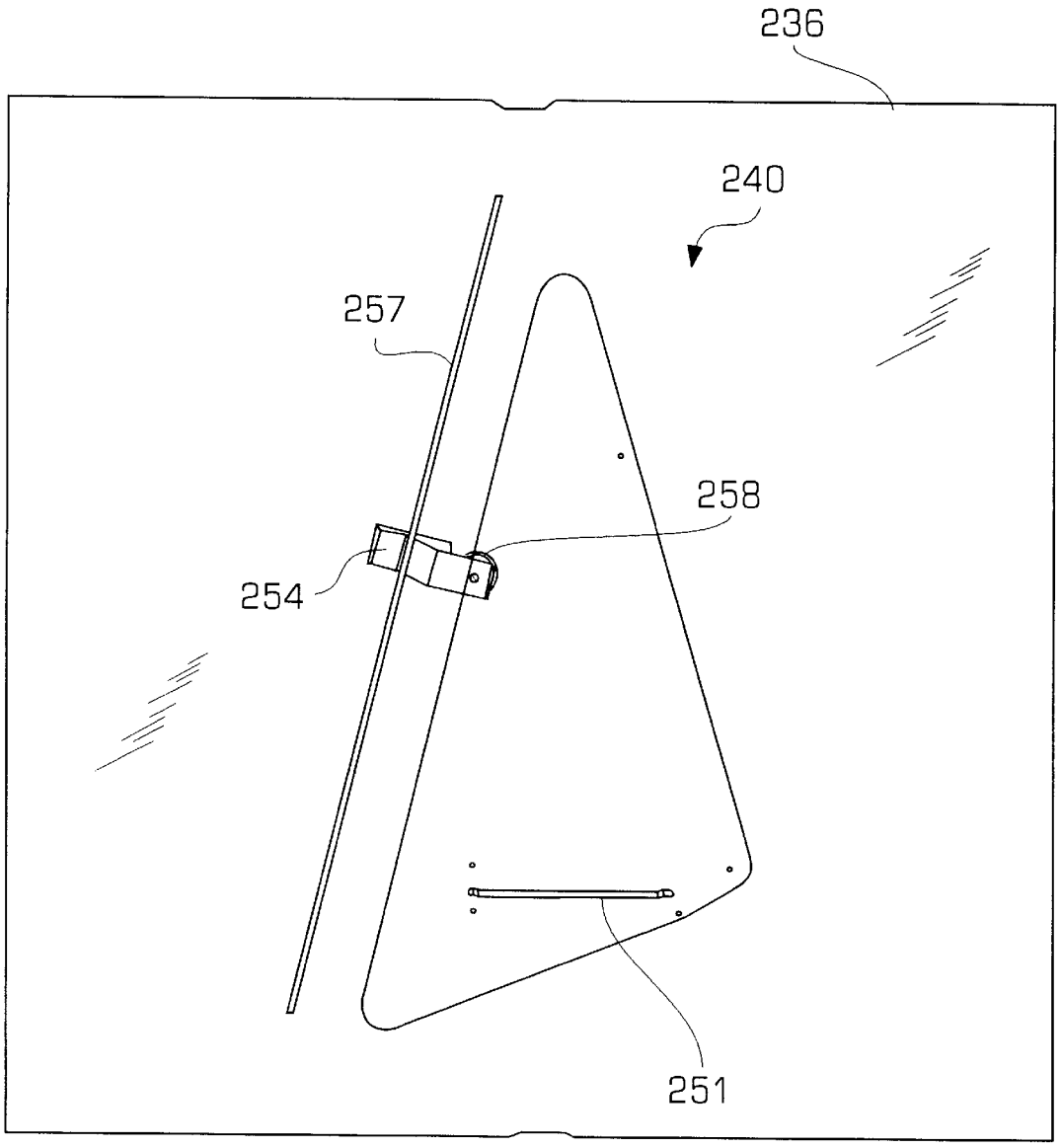
FIG. 15 is a back view of the probability game.

FIG. 13 is a diagram illustrating a panel 236 having a probability chute game 240 in accordance with the invention, FIG. 14 is front view of the probability chute game and FIG. 15 is a back view of the probability chute game. The probability chute game 240 may include a playing field 242 having a predetermined shape and one or more obstacles 244, such as posts of pins. The invention, however, is not limited to the shape of the playing field shown. A plurality of balls 246, which may be magnetically susceptible steel balls, may move down the playing field due to gravity, as will be described, striking the obstacles 244 until the balls drop into one or more counting chutes 248 which permit the number of balls 246 within each counting chute 248 to be counted so that the distribution of the balls between the one or more counting chutes may be observed by the user of the game. The game 140 may also include a sliding gate 250 in a channel 251 for either holding the balls within the counting chutes 248 or releasing the balls into a holding area 252.

When the balls 246 are within the holding area 252, the user of the game may move a control mechanism 254 which slides in a channel 257 formed in the panel from the holding area 252 up to a ball release region 256. In particular, the mechanism 254 may include a magnet 258 located adjacent to the balls 246 in the holding area 252 so that the balls 246 may be attracted to the magnet. Once one or more balls 246 are attracted to the magnet, the balls 246 may be lifted up, by moving the mechanism upwards, to the ball release area where the balls fall away from the magnet, are released, and fall down through the playing field into the counting chutes 248. The motion of the balls through the playing field results in a cascade of sound and motion. The balls end up being distributed into the counting chutes in a roughly binomial distribution. In this manner, the user of the game may view the magnetic attraction between the magnet and the balls and then view the probabilistic distribution of the balls in the counting chutes after falling through the playing field.

In summary, the apparatus may display the magnetic interactions between magnetic objects to a plurality of users. The apparatus may also provide the users with a goal so that the users will continue to repeatedly use the devices and learn and become educated about the invisible magnetic interactions between magnetic objects.

While the foregoing has been with reference to a particular embodiment of the invention, it will be appreciated by those skilled in the art that changes in this embodiment may be made without departing from the principles and spirit of the invention, the scope of which is defined by the appended claims.

I claim:

1. An apparatus for displaying properties of magnetic fields, comprising:

a chassis;

one or more panels slideable into the chassis, each panel including a game for displaying different properties of magnetic fields; and one of said games comprising a probability chute game further comprising a playing field having a plurality of obstacles, a plurality of magnetizable balls which fall down through the playing field and strike the obstacles, a control mechanism having a magnet that magnetically attracts the balls and lifts the balls to a position for release into the playing field, a plurality of horizontally distributed counting chutes for counting the number of balls which fall through the playing field into each counting chute to display the distribution of the balls into the counting chutes.

2. The apparatus of claim 1, wherein the playing field further comprises a release area at the top of the playing field from which the balls are released into the playing field by the magnetic control mechanism and a holding area at the bottom of the playing field from which the balls are attracted by the magnetic control mechanism so that the magnetic control mechanism moves the balls from the holding area upwards to the release area using magnetic forces.

3. The apparatus of claim 1, wherein the chassis comprises a bottom portion and a top portion and the apparatus further comprising a pendulum having first and second ends, the first end being suspended from the top portion of the chassis, the pendulum further comprising a magnetic element attached to the second end, a rotatable control member having a magnetic element attached to the end of the control member, the rotatable control member magnetically coupling with the magnetic element on the end of the pendulum to control the motion of the pendulum, and a plurality of devices for interacting with the magnetic element located adjacent to the second end of the pendulum.

4. The apparatus of claim 3, wherein said plurality of devices that interact with the pendulum comprise a spring attached to the housing, and a magnetic element attached to the spring that moves when said magnetic element of the pendulum approaches said magnetic element on the spring.

5. The apparatus of claim 1 further comprising a body having a predetermined shape rotatably attached to one of said panels, a magnetic element attached to said body and a control member having a magnetic element that interacts with the magnetic element attached to said body so that the body rotates in response to interaction between the magnetic elements of the control member and the body.

6. The apparatus of claim 5, wherein said body comprises a clown body.

7. The apparatus of claim 1, wherein the plurality of obstacles are arranged on the playing field such that balls collide with the obstacles and form a binomial probability distribution across the counting chutes.

8. The apparatus of claim 7, wherein the plurality of obstacles are arranged on the playing field in a triangular pattern.

* * * * *